US005411114A

United States Patent [19]

Bedi et al.

[11] Patent Number: 5,411,114

[45] Date of Patent: May 2, 1995

[54] COUPLER FOR QUICK DISCONNECT OIL CHANGE SYSTEM

[75] Inventors: Ram D. Bedi; Adrianus J. van der Griendt, both of Bloomfeld Hills, Mich.

[73] Assignee: K.J. Manufacturing Co., Wixom, Mich.

[21] Appl. No.: 199,476

[22] Filed: Feb. 22, 1994

[51] Int. Cl.[6] ..... F16C 3/14

[52] U.S. Cl. ..... 184/1.5; 285/176; 285/206; 138/DIG. 11

[58] Field of Search ..... 184/1.5; 285/176, 184, 285/205, 206, 901; 138/109, DIG. 11; 123/196 R

[56] References Cited

U.S. PATENT DOCUMENTS

| | | | |
|---|---|---|---|
| 1,734,966 | 11/1929 | Elmendorf | 285/206 |
| 2,397,290 | 3/1946 | Rasmussew | 285/206 |
| 4,492,392 | 1/1985 | Woods et al. | 285/205 |
| 4,745,894 | 5/1988 | Laipply et al. | 123/196 R |
| 4,756,349 | 7/1988 | Atkins | 184/1.5 |
| 4,951,723 | 8/1990 | Hoeptwer, III | 184/1.5 |
| 5,131,497 | 7/1992 | Rogers | 184/1.5 |

OTHER PUBLICATIONS

Aeroquip Bulletin, "Flocs Fast Lube Oil Change System", Jun. 1990, Bulletin No. JB13.

*Primary Examiner*—Thomas E. Denion
*Attorney, Agent, or Firm*—Basile and Hanlon

[57] ABSTRACT

An apparatus and method for retrofitting a vehicle for removing spent oil from an oil pan reservoir by installing the apparatus in an access aperture located in a sidewall of the oil pan reservoir. The apparatus comprises a bent tube, having a widened and flattened first end and a flared second end, engages through the access aperture allowing the flattened end to rest along the oil pan floor. A slidable adapter is mounted on the tube, having one end adaptable for threading into the access aperture and a second end to press fit around the flared end of the tube to form a seal and to prevent rotational movement of the tube. The second end of the adapter is also adaptable for threading into a quick connect nipple.

4 Claims, 2 Drawing Sheets

COUPLER FOR QUICK DISCONNECT OIL CHANGE SYSTEM

FIELD OF THE INVENTION

The invention relates to a device for changing motor oil in a vehicle having an oil pan or similar oil reservoir.

BACKGROUND OF THE INVENTION

The benefits of routine oil changes in a vehicle are well-known, Routine oil changes have been shown to increase engine life and performance. With repeated prolonged use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine performance and if left unchanged can destroy or cripple the engine performance. It is recommended by at least one oil manufacturer that the level of total solid concentration be limited to levels below 3.0% with the levels of silica being present in amounts lower than 25 parts per million and sodium in amounts lower than 200 parts per million.

In currently designed vehicles, the oil pan serves the purpose of a reservoir for circulation of engine oil. Engine lubrication is generally accomplished through a gear-type pump. The pump picks up engine oil from the oil pan sump or oil is drawn up through the pick-up screen and tube, and is passed through the pump to the oil filter. The oil filter is generally a fullflow paper element unit. In some vehicles, an oil filter bypass is used to ensure adequate oil supply, should the filter become plugged or develop excessive pressure drop. Oil is routed from the filter to the main oil gallery. The gallery supplies valve train components with oil, and by means intersecting passages, supplies oil to the cam shaft bearings. Oil draining back from the rocker arms is directed, by cast dams in the crank case casting, to supply the cam shaft lobes. Oil also drains past specific hydraulic lifter flats to oil cam shaft lobes directly. The passages supplying oil to the cam shaft bearings also supply the crank shaft main bearings through intersecting passages. Oil from the crank shaft main bearings is supplied to the connecting rod bearings by means of intersecting passages in the crank shaft. The front cam bearing can include a slot on its outside to supply oil to the cam sprocket thrust face. In some engines, many internal engine parts have no direct oil feed and are supplied either by gravity or splash from other direct feed components. A bypass valve can also be disposed in the oil pick-up screen to ensure adequate oil flow if the screen should become restricted. A pressure regulator valve, sometimes located in the oil pump body, maintains adequate pressure for the lubrication system and bypasses any excess back to the suction side of the pump. Oil from the pump passes through the filter before going to the engine oil galleries. In the filter, the oil passes through a filtering element where dirt and foreign particles are removed.

To remove the contaminated oil, the drain plug, generally located in the lowermost region of the oil pan, is opened. The spent oil containing suspended particles is permitted to flow under gravity out of the pan into a suitable receptacle. After the spent oil is removed, the plug is replaced and fresh oil is added to the engine usually through a separate opening in the engine valve cover.

The oil change process is essentially the same whether performed at home, at service stations or at one of the various oil change centers which have opened in recent years. The flow rate, or time required for oil drainage, is almost the same for each of these locations because it is limited by the size of the drain plug aperture and the force of gravity.

Therefore, it would be desirable to provide a method which accelerates removal of spent oil conveniently, more completely, and easily from the crank case. It would also be desirable to provide a system which reduces the amount of spent oil handling as required in a conventional oil change service station. Finally, it is desirable to provide a method which would be easily employed by vehicle owners, especially those owning fleets such as truck fleet and car rental companies, with benefits of the method of the present invention such as time savings, money savings, convenience, minimum exposure to motor oil, environmental protection, energy conservation and finally, longer-lasting, better performing engines.

SUMMARY OF THE INVENTION

The present invention is an apparatus and method for retrofitting a vehicle for easy and complete removal of spent oil from an internal combustion engine. Many vehicles, in addition to having an oil drain plug at the bottom of the oil pan of the engine, also have an access plug located on a lower side of the oil pan. A retrofit at the access plug is advantageous in that the clearance from the ground is adequate to prevent any possible destruction of any part of the apparatus extending from the plug. In addition, the access plug location offers more protection to the apparatus from environmental elements. One disadvantage of a retrofit at the access plug is that since the access plug is generally a couple of inches above the bottom of the oil pan, for example, Detroit Diesel Series 60 1993 engine, the retrofit must include a means to reach the lowermost portion of the oil pan. The present invention addresses these concerns.

The invention includes the steps of removing the access plug from the oil pan of the engine, inserting a specially engineered tube through the plug aperture until it reaches the bottom of the oil pan of the engine, and starting a vacuum pump means to create vacuum within a spent oil container connected to the tube, thereby drawing spent oil from the oil pan of the engine into the environmentally-safe spent oil container external of the engine. After the spent oil is removed from the oil pan of the engine, the vacuum pump means is disconnected. An integrally attached dust cap can then be installed over the exterior end of the engineered tube until the next required oil change. Oil can then be replenished in the engine by pouring the oil through a valve cover opening as is conventional.

The apparatus of the present invention includes a rigid tube having a flange at one end and being flattened and widened at the other end. The tube may be of quite complex geometry and contain multiple bends in order to avoid obstacles on the way to reach the lowest portion of the oil pan. Proximate to the flanged end, the tube slightly flares to facilitate a press fit seal when the apparatus is installed in the oil pan access aperture. The tube is engageable through the access plug aperture of the oil pan in fluid communication with the oil pan reservoir.

An adapter is slidably and rotatably mounted on the rigid tube between the flanged end and the elbow. The adapter threadably engages with the threads in the access plug aperture at one end to attach the apparatus to the side wall of the oil pan. The adapter allows free rotational movement of the tube to facilitate placement of the flattened end on the oil pan floor. The adapter seals the access plug aperture by various possible means such as (1) using a tapered pipe thread, and (2) using a straight thread with a washer or O-ring. The adapter can then threadably engage with the threads of a quick connect nipple at the other end. The nipple-to-adapter seal is accomplished by means of straight thread with an O-ring. The quick connect nipple is adaptable for communication with a pump means including vacuum means engageable with the spent oil receptacle for creating a vacuum within the receptacle thereby drawing oil into the receptacle through the tube. The vacuum means can include a vacuum pump.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

An engine generally includes an oil pan reservoir with a drain plug at the bottom most region of the oil pan reservoir. Many models also include an access plug aperture 10 and plug along the lower side 12 of the oil pan reservoir. The present invention is a retrofit suction tube 14 that accesses this lower sidewall aperture 10 in order to draw the spent oil from the oil pan of the engine. This is particularly beneficial to fleet vehicles where a number of oil changes must be done as efficiently and quickly as possible.

Figure 4:
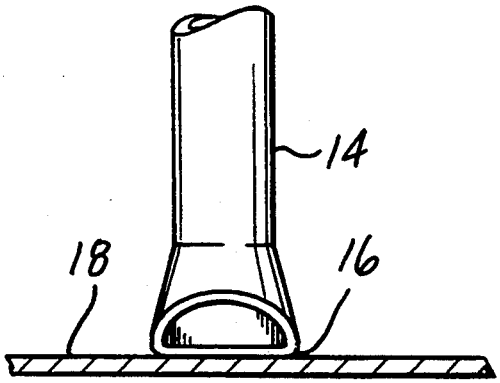
FIG. 4 is a cross-sectional view of the suction tube taken along line 4—4 of FIG. 1.
Figure 2:
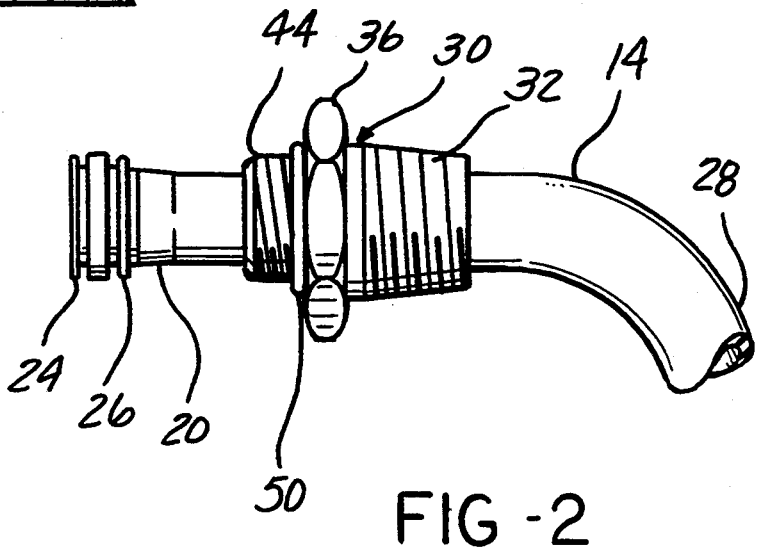
FIG. 2 is a schematic view of a portion of the coupler showing the adapter mounted on the suction tube as intended by the preferred embodiment.

Referring to FIGS. 1–4, the present invention provides an elbow-shaped rigid suction tube 14 engageable through the access plug aperture 10 such that one end 16 of the tube 14 can engage the bottom 18 of the oil pan reservoir. As seen in FIG. 4, the end 16 is flattened so as to access the lowest possible level of oil before air enters the tube 14, the flattened end 16 is widened at this end so as to keep the same flow area as in the rest of the tube. At the other end 20, the tube 14 has a region where the outside diameter of the tube is slightly increased so as to provide for a press-fit during final installation, to be further discussed later. Attached to the end 20 is a spacer 22 and flange 24. An annular sealing means, such as an O-ring 26 is interposed between the flared end 20 and the spacer 22.

Figure 1:
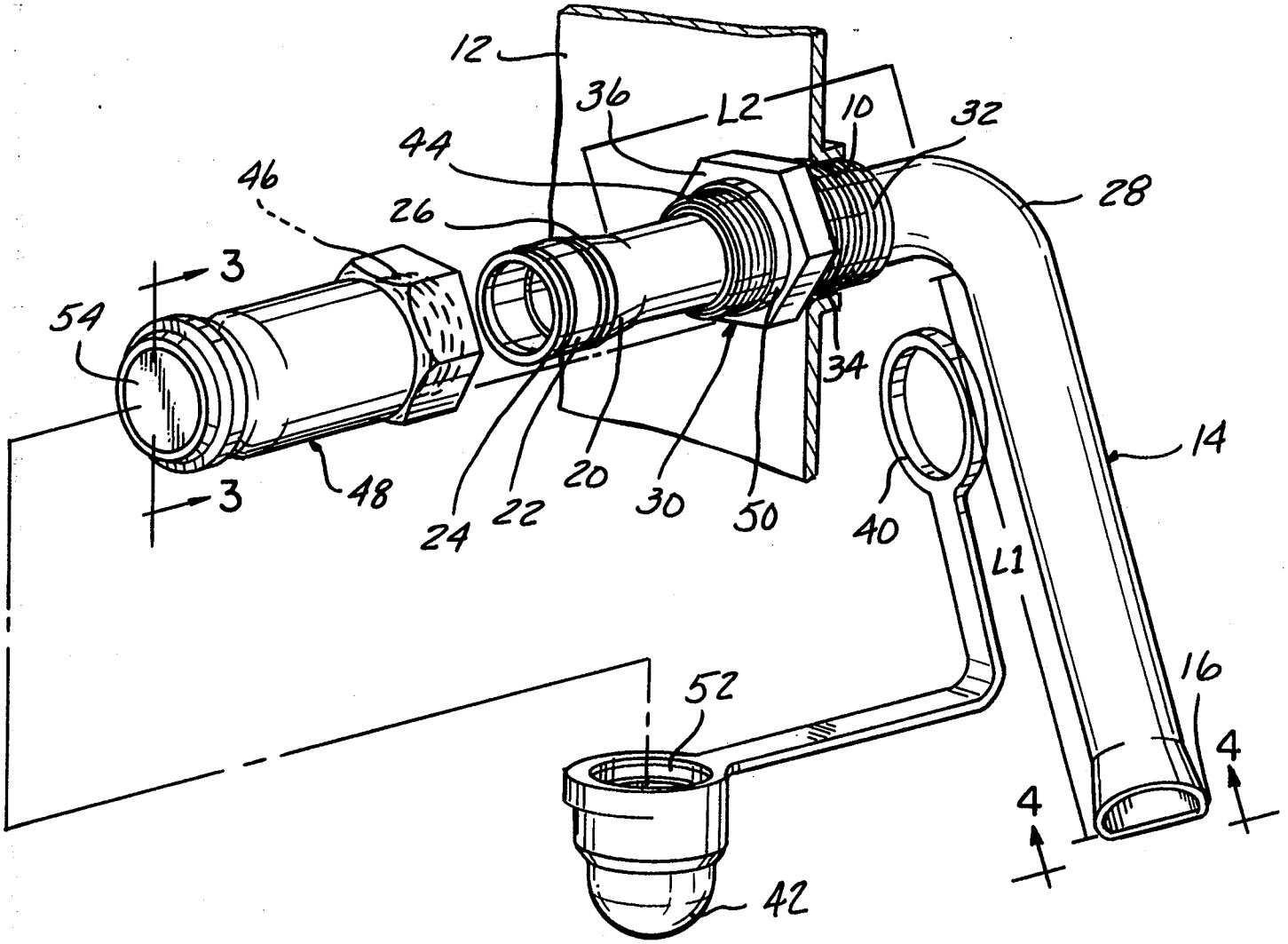
FIG. 1 is an exploded view of components of a coupler for a quick disconnect oil change system mounted to a bottom sidewall of an oil pan and comprising an adapter and a suction tube.
Figure 3:
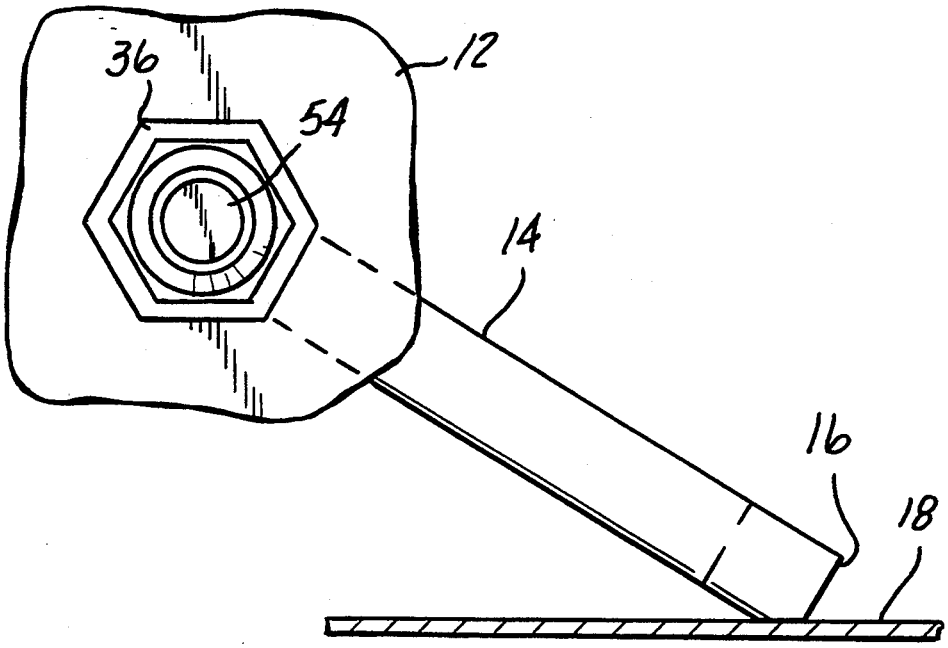
FIG. 3 is a cross-sectional view of the coupler taken along line 3—3 of FIG. 1.

The suction tube 14 is preferably constructed of a non-corrosive metal material or other material impermeable to oil and such. The diameter of the suction tube 14 is such as to be able to easily fit through the plug aperture 10 of the oil pan reservoir. As shown in FIG. 1, the length L1 of the suction tube 14 from the bend 28 to the flattened and widened end 16 is at least the height of the sidewall access plug 12 from the oil pan floor 18. The length L2 of the suction tube 14 from the bend 28 to the flared end 20 is such that an adapter 30 can slidably travel the length L2 during insertion and placement of the tube 14 into the oil pan 12. The elbow shape of the suction tube 14 allows the tube 14 to extend to the bottom 18 of the oil pan from a side entrance plug aperture 10.

The slidable adapter 30 is mounted on the suction tube 14 between the bend 28 and the flared end 20. The flange 24 is necessary to keep the tube 14 in place, i.e., from "falling" into the oil pan 12. The spacer 22 is used to keep the flange 24 pressed against the face of the threaded region 44. The quick connect nipple has an internal "stop" against which flange 24 rests The O-ring 26 is needed as a "tolerance" because the same nipple seals against the hex head 36 and O-ring 50 at the same time, i.e., to affect two seals at the same time. The end 20 with the slightly increased outside diameter on the tube 14 enables a "press-fit" inside the adapter 30. This prevents future rotation of the tube 14 and also provides an extra annular seal. The slidable feature of the adapter 30 provides for easy placement of the flattened and widened end 16 of the suction tube 14 along the oil pan bottom 18. The first end 32 of the adapter 30 facing the bend 28 has a tapered, externally threaded male end to coincide with an internally threaded female end 34 around the plug aperture 10. To facilitate attachment of the adapter 30 in the access plug aperture 10, the adapter 30 may have a centrally positioned square or hexagonal shaped portion 36 adapted to be engaged by known tools for turning the adapter 30 to threadingly engage with the aperture 10 of the access plug. The second end 44 of the adapter 30 facing the flared end 20 of the tube 14 also has an externally threaded male end for adapting to an internally threaded female end 46 of a quick connect nipple 48. Interpositioned between threads 44 and the hexagonal shaped portion 36 is a sealing gasket or O-ring 50 to provide an annular seal between the adapter 30 and the quick connect nipple 48.

The protection means 42 is one which ideally will remain in place during routine engine operation and would provide ready access to the quick connect nipple 48 when an oil change is required. In the preferred embodiment of this invention, the protection means is a removable dust cap 42 having a hollow interior 52 into which the outlet end 54 of the quick connect nipple 48 can be inserted. The dust cover or cap 42 is configured to permit sufficiently secure contact between the dust cap 42 and the nipple 48 so that accidental disengagement of the dust cap 42 during normal engine operation is prevented. The means of engagement between the dust cap 42 and the nipple 48 may be suitable means such as mechanical, frictional, or combinations thereof. The preferred dust cap 42 has a ring holder 40 at one end to slidably engage onto the quick connect nipple 48. The ring holder 40 may be stretched over quick connect nipple 48 and kept in place by friction. The ring holder 40 allows the dust cap 42 to remain in place during routine vehicular operation and provide ready access to the quick connect nipple 48 during oil change operations.

Various types of quick connect nipples are known in the art and are commercially available. The quick connect fitting allows various flexible hoses to be connected to the suction tube. The quick connect nipple 48 or fitting has a first end having an integrally threaded surface 46 adapted to matingly and sealingly engage the externally threaded surface 44 on the slidable adapter 30. The first end 46 of the quick connect nipple 48 can overlay the flange 24 and spacer 22 of the suction tube 14, and be maintained in position by the threaded connector 44 of the adapter 30. The quick connect nipple 48 has a second end 54 opposed to the first end 46 which is sealingly connectible with a mating fitting (not shown) located on an external fluid egress hose.

The preferable procedure to retrofit the apparatus onto the vehicles in the aftermarket is to apply a commercial thread sealant to the first threaded end 32 of the adapter 30. Remove the access plug from the access plug aperture 10 in bottom side 12 of the oil pan reservoir. Insert the flattened and widened end 16 of the suction tube 14 through the opening 10. Align the adapter fitting 30 and threaded end 32 of the adapter 30 into the threaded opening 34 until secure. Rotate the suction tube 14 from the flanged end 24 clockwise until contact is made with the bottom 18 of the oil pain. In the preferred embodiment a mark 54 would be placed on the flanged end 24 of the tube 14 so that it would indicate a twelve o'clock or other predetermined position to signify that the flattened end 16 is flush with the oil pan bottom 18. Press the flanged end into the adapter fitting 30. The flared end 20 of the tube 14 provides a press fit seal of the adapter 30 and the tube 14. Tap the tube 14 at the flange 24 in place using a rubber mallet or a piece of wood with a hammer so as to avoid damage to the flange 24, making sure the tube 14 does not rotate out of position. This procedure further seals the adapter 30 to the O-ring 26. Clean the threads at the second end 44 of the adapter 30 that are to mate with the female threaded end 46 of the quick connect nipple 48. Apply a commercially available thread locking compound to threaded end 44. Thread the quick connect nipple 48 on to the adapter 30 and tighten until secure. Install the dust cap 42 over the end 54 of quick connect nipple 48. Subsequent oil changes will merely require removal of the dust cap 42 and hook up to a vacuum pump means engageable with a spent oil receptacle.

In this manner an internal combustion engine can be easily, effectively, and conveniently retrofitted to permit efficient, economical and environmentally-safe oil changes.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for retrofitting a vehicle for changing oil in an internal combustion engine having an oil pan reservoir, the oil pan reservoir having a floor bottom and an access aperture on a sidewall of the oil pan reservoir, the apparatus for retrofitting the vehicle comprising:

a quick connect nipple;

a suction tube engageable through the access aperture having an exterior surface and a first end positionably adjacent to the floor bottom and a second end external to the oil pan reservoir; and an adapter slidably mounted on the exterior surface of the suction tube and having a first end adaptable to sealingly engage with the access aperture and a second end adaptable to sealingly engage with the quick connect nipple.

2. An apparatus as described in claim 1 wherein the first end of the suction tube is flattened and widened whereby the flattened end is exposed against the floor bottom.

3. An apparatus as described in claim 1 wherein the second end of the suction tube has a flared end and a flange proximate to the flared end, whereby the adapter is press-fitted and seals around the flared end to prevent rotational movement of the tube.

4. An apparatus for retrofitting a vehicle for changing oil in an internal combustion engine having an oil pan reservoir, the oil pan reservoir having a floor bottom and access plug threadably removable for providing an aperture on a sidewall of the oil pan reservoir, the apparatus for retrofitting the vehicle comprising:

a quick connect nipple;

a bent suction tube having a diameter for engaging through the access aperture such that a first end of the tube engages the floor bottom of the oil pan reservoir, said first end of the suction tube is flattened and widened, wherein the flattened end lies against the oil pan floor; said suction tube having a second end external to the oil pan reservoir, said second end being slightly flared; and a slidable adapter mounted on the suction tube between the bend and the flared end, said adapter having a first end threadably mating to the access aperture and a second end engaging with the flared end of the suction tube thereby providing an annular seal of said suction tube and slidable adapter, said second end of said adapter threadably mating to the quick connect nipple.

* * * * *